United States Patent [19]

Andersson

[11] Patent Number: 5,046,556

[45] Date of Patent: Sep. 10, 1991

[54] SURFACE ENLARGING ELEMENTS FOR HEAT-EXCHANGER TUBES

[75] Inventor: Erik Andersson, Södertälje, Sweden

[73] Assignee: Gadelius Sunrod AB, Sweden

[21] Appl. No.: 634,119

[22] PCT Filed: Aug. 28, 1989

[86] PCT No.: PCT/SE89/00448

§ 371 Date: Dec. 28, 1990

§ 102(e) Date: Dec. 28, 1990

[87] PCT Pub. No.: WO90/02917

PCT Pub. Date: Mar. 22, 1990

[30] Foreign Application Priority Data

Sep. 13, 1988 [SE] Sweden ..... 8803215

[51] Int. Cl.[5] ..... F28F 1/20

[52] U.S. Cl. ..... 165/181; 165/109.1

[58] Field of Search ..... 165/181, 182, 109.1

[56] References Cited

U.S. PATENT DOCUMENTS

| | | | |
|---|---|---|---|
| 2,402,262 | 6/1946 | Sewell | 165/182 |
| 4,648,443 | 3/1987 | Szucs et al. | 165/181 |

FOREIGN PATENT DOCUMENTS

| | | | |
|---|---|---|---|
| 2628866 | 1/1978 | Fed. Rep. of Germany | 165/181 |
| 2131828 | 11/1972 | France | 165/181 |
| 59-112196 | 6/1984 | Japan | 165/181 |
| 288848 | 2/1953 | Switzerland | 165/181 |
| 590715 | 7/1947 | United Kingdom | 165/181 |

*Primary Examiner*—Allen J. Flanigan

*Attorney, Agent, or Firm*—Ostrolenk, Faber, Gerb & Soffen

[57] ABSTRACT

A tube (10) in a heat exchanger, along which a gas transporting heat travels perpendicular to the longitudinal axis of the tube is provided with surface enlarging elements in the form of pieces of metal (11) having a width (B) substantially equivalent to twice the outer diameter of the tube, and a depth equivalent to approximately half its width. One long side of the piece of metal (11) is provided with a circular recess fitting the tube and extending through an angle of less than 180°, and the long edge of the piece of metal facing away from the tube is provided with three slits (14, 15, 16). One of these slits is located centrally and the other two are placed so that the metal tongues (17) produced are substantially equal in width. The central slit is deeper than the others.

8 Claims, 3 Drawing Sheets

SURFACE ENLARGING ELEMENTS FOR HEAT-EXCHANGER TUBES

Figure 1:
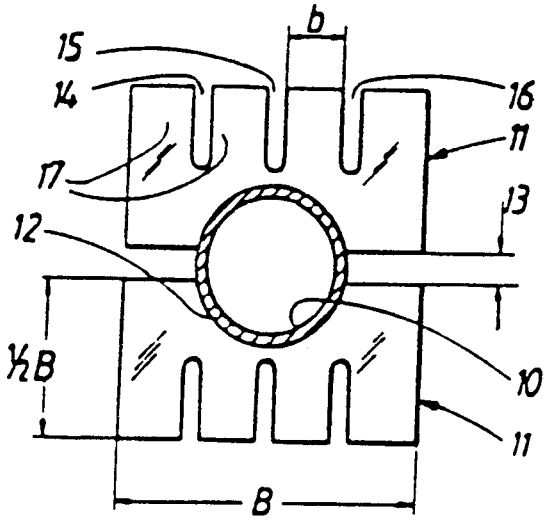

The present invention relates to a surface enlarging element for heat-exchanger tubes of the type defined in the preamble to claim 1.

When heat is being exchanged between media of greatly differing thermal exchange content, the heat exchanger surface in contact with the medium with lower thermal exchange content is normally provided with surface enlarging elements so that the heat flow balances that which can be achieved on the opposite side of the heat exchanger.

Such is the case, for instance, with steam or hot-water boilers or with economisers connected after such boilers, where water passes through the tubes while flue gases or other hot fluids travel along the exterior of the tubes, usually in a direction perpendicular to the longitudinal axis of the tubes. (Longitudinal flow is also known.)

Various surface enlarging elements have been developed over the years, comprising pins, fins, plates and strips which are welded perpendicular to or along the tubes, as well as elements in ribbon form being applied helically around and along the tube.

With known surface enlarging elements it has proved difficult to limit production costs for the heat exchangers and at the same time offer heat exchangers which can relatively easily be kept clean on the outside and are subject to negligible deformation during operation.

One object of the invention is therefore to propose a surface enlarging element for heat exchanger tubes of the above type, which element can be produced easily and at low cost and can be simply and cheaply welded to the tube, resulting in a construction which can be efficiently cleaned and is subject to a negligible deformation during operation.

Although the invention is described above and in the following as pertaining to heat exchangers for exchanging heat between flue gases and water for steam production, it should be obvious that the surface enlarging element according to the invention can perfectly well be used for heat exchangers designed for other fluids.

Heat exchangers of the type under consideration generally comprise parallel tubes arranged with equal spacing between them, the surface enlarging elements on adjacent tubes substantially abutting each other in common normal planes to the tube axes so that the surface enlarging elements in each such common plate together substantially define a complete screen, these screens guiding the gas flow through the heat exchanger. The surface enlarging elements on a tube therefore suitably cover a rectangular, preferably square surface, centered around the tube.

There are conventionally two main types of surface enlarging elements, differing in the manner in which they are secured to the tube. One type consists of plates having a central hole in which the tube is placed and secured to the plates. The other type comprises substantially rectangular plates with a length substantially twice the width. These plates have a substantially semicircular recess in one long side and are designed to be resistance welded to the tube so that the plates suitably lie in a normal plane to the axis of the tube. The plates are preferably welded in pairs to opposite sides of the tube in a common plane.

However, we have realized that, from the production aspect the second type of plate is necessary. However, we have found from experience that the known surface enlarging elements of this type do not function satisfactorily. They exhibit an unsatisfactory thermal balance, for instance, resulting in deformation during operation. Such deformation entails an uncontrolled rise in flow resistance in the heat exchanger, as well as the risk of dirt and soot being more quickly deposited on the plates, which in turn necessitates more frequent cleaning. We have thus established that the heat flow in the surface enlarging element becomes unevenly distributed around the tube in the known surface enlarging elements.

We have discovered that to achieve economic production and good function of the heat exchangers, i.e. to achieve the object of the invention, the surface enlarging element must have the features defined in claim 1, i.e. its shape must conform to that of the tube for resistance welding and it must have slits arranged in a specific manner. A preferred embodiment of the slits is defined in claim 2.

In order to achieve favourable welding conditions, the radius of the recess in the element should preferably be slightly greater than the radius of the tube, for instance 1 mm greater, which is suitable if the tube radius is about 20 mm. A homogeneous weld is then possible.

Furthermore, the surface of the tube and/or recess is preferably ground with a coarse grinding wheel, so that the grinding scores permit gases formed during the welding process to be drawn off.

The tongues in the element defined by the slits may be turned, bent or deformed in some other way to offer increased turbulence in the passing fluid. The fluid (flue-gas) passes in the plane of the surface enlarging elements, substantially perpendicular to the direction of the slits in the elements.

By making tongues of equal width separated in accordance with the invention by slits which preferably become gradually shallower towards the side edges of the element, the tongues become less deformed during operation and the temperature conditions will be equivalent at their outer ends, i.e. at the periphery of the surface enlarging elements, while at the same time surface enlarging elements in common planes form well defined flow paths for the outer fluid (e.g. flue-gas) in the heat exchanger.

The invention and embodiments thereof are defined in the appended claims.

Figure 2:
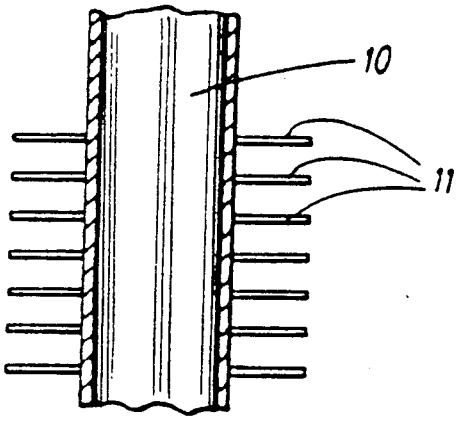
Figure 3:
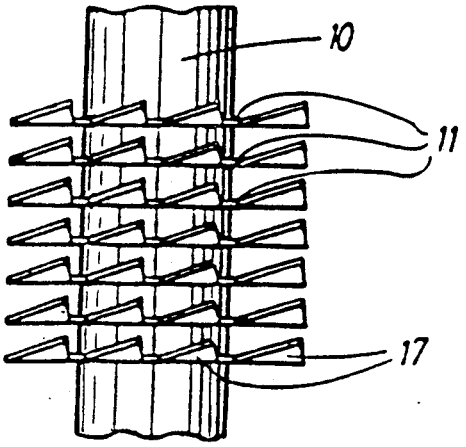
Figure 4:
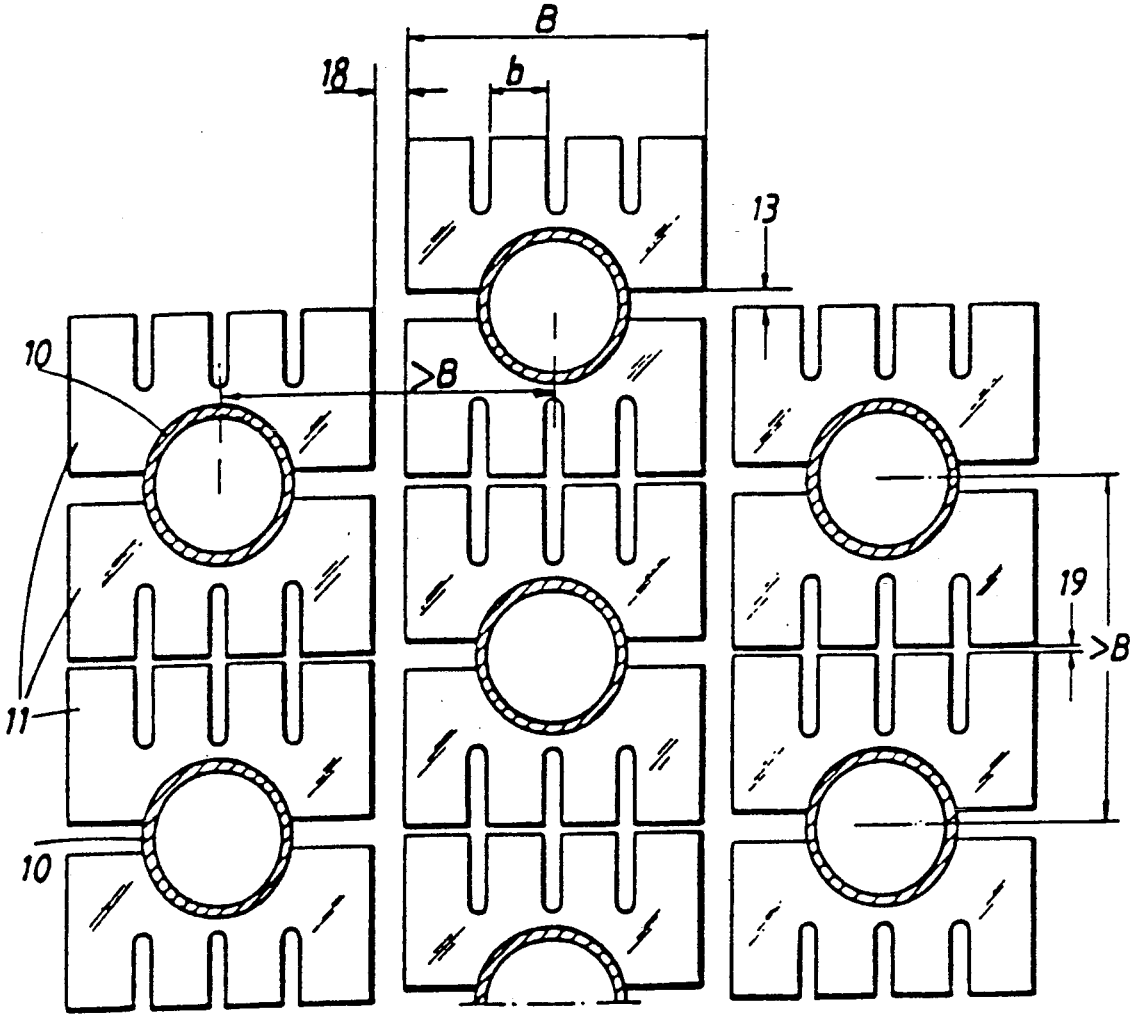
Figure 5:
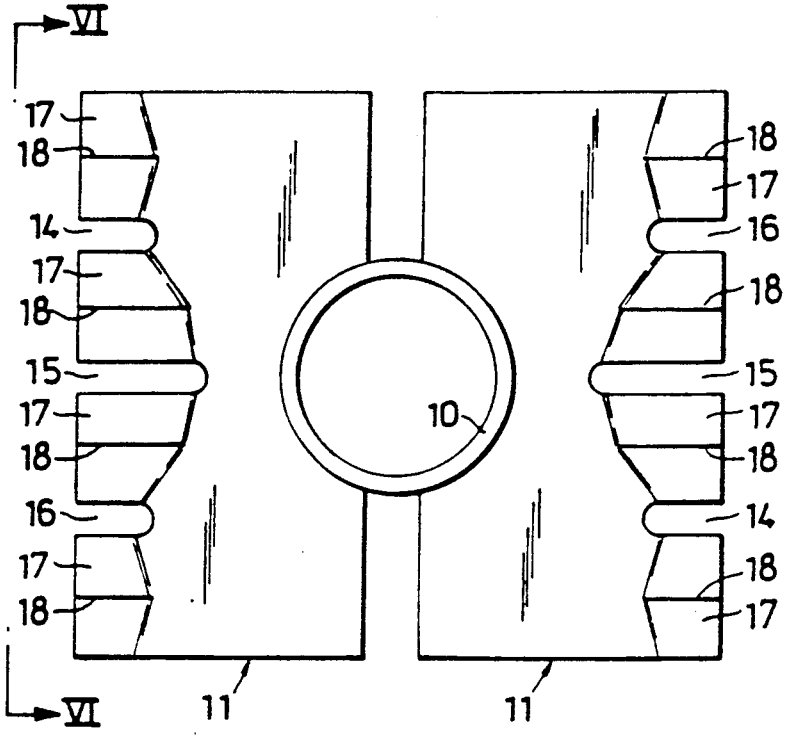
Figure 6:
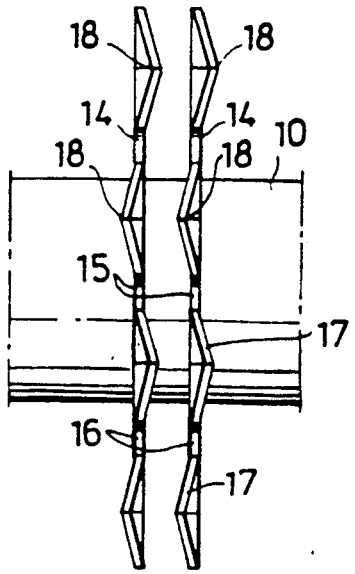

The invention will be described by way of example in the following with reference to the accompanying drawings, in which FIG. 1 shows a cross section through a heat exchanger tube provided with surface enlarging elements in accordance with the invention, FIG. 2 shows an axial section through a portion of a heat exchanger tube as illustrated in FIG. 1, FIG. 3 shows a side view of a longitudinal portion of a heat exchanger tube as illustrated in FIG. 1 in which the tongues of the surface enlarging elements are deformed by bending, FIG. 4 shows a section through a part of a heat exchanger comprising a plurality of parallel tubes, FIG. 5 shows another embodiment of a surface enlarging element according to the invention, and FIG. 6 shows an end view seen in the direction of the arrows VI—VI in FIG. 5.

In FIG. 1, 10 denotes a tube forming part of a heat exchanger and provided with surface enlarging elements in the form of metal pieces 11 welded onto the outside of the tube. The pieces 11 are welded pairwise to the tube in the same plane, suitably by means of resistance welding and, as can be seen in FIGS. 2 and 3, the pairs of metal plates are arranged closely spaced along the tube, for instance 10 mm apart.

Each piece of metal 11 has a width B appropriate for the installation, a suitable width being approximately twice the outer diameter of the tube, and a depth of approximately 0.5 B.

In one long side of the piece of metal, in its mid-region, is a substantially circular recess. The radius of this recess is somewhat greater, e.g. 1 mm greater, than the radius of the tube, and its depth is less than the radius. The edge of the recess thus extends through an angle of somewhat less than 180°. A gap 13 is thus obtained between two pieces of metal 11 welded to the tube in the same plane. This facilitates welding and also permits a certain amount of gas to flow transverse to the plan of the metal pieces.

The difference in radius ensures a satisfactory, homogeneous welding jont if resistance welding is performed under pressure. The quality of the weld can be further improved if the surface of the tube and/or the attachment edge of the metal piece is coarse ground so that the grinding scores allow gas to be drawn off during the welding operation.

Three substantially similar, parallel slits 14, 15, 16 are provided in the edge of the metal element 11 facing away from the tube. The middle slit 15 is located centrally and extends almost to the tube. The two outer slits 14, 16 are placed so that the metal tongues 17 produced are of substantially equal width "b". This ensures good heat distribution through the piece of metal, with less risk of it being deformed.

As can be seen more clearly in FIG. 3, the tongues may be deformed by bending their outer edges in the same direction in relation to the mid-plane of the plate, for instance. This creates a turbulent flow past the tube, thus improving the heat transfer and facilitating, the removal of any soot particles.

FIG. 4 shows a portion of a heat exchanger comprising a number of parallel tubes 10 with surface enlarging elements 11. The tubes are arranged in parallel rows, the distance between the rows being greater than B, a gap 18 thereby being formed between transverse edges of opposite elements 11 which is approximately as wide as the gap 13 between two elements on the same tube.

In the embodiment shown the tubes in adjacent rows are displaced half a pitch in known manner, which can be done without inconvenience with the shown embodiment of the metal elements.

The centres of the tubes in each row are spaced further apart than the sum of B and 13, so that a small space 19 is formed between neighbouring elements on two tubes in the same row.

FIG. 5 shows a surface enlarging element in which the depth of the slits decreases towards the short sides of the element. The slides are thus deeper in the mid-region of the longitudinal direction of the element. This variation in depth of the slits, combined with tongues 17 of equal width, has proved to offer a particularly uniform temperature distribution during operation for the peripheral area of the surface enlarging element, which in turn entails negligible thermal deformation.

As indicated in FIG. 6, the tongues 17 may be deformed to an angled cross section, neighbouring tongues thus being bent in opposite directions. The deformation illustrated in FIG. 6 constitutes an alternative to the deformation illustrated in FIG. 3.

In FIGS. 5 and 6 the spines of the tongue are indicated by the lines 18.

The element 11 may be of the same material as the tube 18, e.g. steel. It is important that the material of the element has high thermal conductivity since this will improve its efficiency. If steel is used, therefore, a steel with low carbon content is preferably selected.

In the embodiment according to FIG. 5, the slits 14–16 have a width of 6 mm, the central slit 15 has a depth of 25 mm and the outer slits have a depth of 15 mm. The two central tongues have a width of 19 mm and the two outer tongues have a width of 22 mm. The length of the element 11 is 100 mm and its width is 55 mm. The recess has a radius of about 23.5 mm and a depth of about 17.5 mm. The distance between the centres of the tubes in the longitudinal direction of the element 11 is about 108 mm, whereas the distance between the centres of the tubes in the transverse direction of the element is about 125 mm in one example of a heat exchanger.

I claim:

1. A surface enlarging element for heat-exchanger tubes, comprising a substantially rectangular piece of sheet-metal (11) provided in the mid-region of one long side with a substantially circular recess extending through an angle of less than 180° and designed to be welded to the tube, characterized in that the piece of sheet-metal is provided with slits (14, 15, 16) extending from the other long side of the piece of metal and running generally parallel with the short sides of the piece of sheet-metal (11), said slits (14, 15, 16) decreasing in length from the middle of said piece of metal towards its short sides.

2. A surface enlarging element according to claim 1, characterized in that the length of the longest slit (15) corresponds to half the width of the element.

3. A surface enlarging element according to claim 1 or 2, characterized in that the tongues (17) in said element defined by the slits (14, 15, 16) are deformed from the mid-plane of the element.

4. A surface enlarging element according to claim 1, characterized in that the tongues (17) defined by the slits are of substantially equal width.

5. A surface enlarging element according to claim 1, characterized in that the radius of the recess is slightly greater than the radius of the tube to which the element is to be attached by resistance welding.

6. A heat exchanger tube provided with surface enlarging elements, characterized in that the surface enlarging elements are constructed in accordance with claim 1 and welded to the tube by resistance welding.

7. A heat-exchanger tube according to claim 6, characterized in that the surface of a welding joint on the tube or on the surface enlarging element is provided with scores, allowing gas to be drawn off from the welding joint during the resistance welding process.

8. A heat-exchanger tube as claimed in claim 6 characterized in that the surface enlarging elements are welded onto the tube in pairs located opposite each other.

* * * * *